United States Patent [19]

Okui

[11] Patent Number: 4,993,374

[45] Date of Patent: Feb. 19, 1991

[54] ENGINE UNIT FOR MOTOR VEHICLE

[75] Inventor: Kaoru Okui, Iwata, Japan

[73] Assignee: Yamaha Hatsudoki Kabushiki Kaisha, Iwata, Japan

[21] Appl. No.: 461,832

[22] Filed: Jan. 8, 1990

Related U.S. Application Data

[62] Division of Ser. No. 270,260, Nov. 14, 1988, Pat. No. 4,915,070.

[30] Foreign Application Priority Data

| | | | |
|---|---|---|---|
| Mar. 31, 1988 | [JP] | Japan | 63-78538 |
| Mar. 31, 1988 | [JP] | Japan | 63-78537 |
| Mar. 31, 1988 | [JP] | Japan | 63-78536 |
| May 11, 1988 | [JP] | Japan | 63-112573 |

[51] Int. Cl.[5] ..... F01L 1/04

[52] U.S. Cl. ..... 123/90.31; 123/196 R; 123/90.27

[58] Field of Search ..... 123/90.27, 90.31, 90.17

[56] References Cited

U.S. PATENT DOCUMENTS

| | | | |
|---|---|---|---|
| 2,857,773 | 10/1958 | Slonek | 123/90.31 |
| 3,482,553 | 12/1969 | Buchwald | 123/90.31 |
| 3,673,990 | 7/1972 | Alfieri | 123/52 R |
| 4,131,096 | 12/1978 | Mitchell | 123/90.31 |
| 4,331,212 | 5/1982 | Tsuboi | 123/54 A |
| 4,617,882 | 10/1986 | Matsumoto | 123/90.31 |
| 4,643,143 | 2/1987 | Uchiyama et al. | 123/90.31 |
| 4,677,948 | 7/1987 | Candea | 123/196 R |
| 4,692,129 | 9/1987 | Fuchigami et al. | 123/90.31 |
| 4,716,864 | 1/1988 | Binder | 123/90.31 |
| 4,741,299 | 5/1988 | Matsuura et al. | 123/90.31 |
| 4,745,887 | 5/1988 | Ito | 123/90.31 |

FOREIGN PATENT DOCUMENTS

| | | |
|---|---|---|
| 3641201 | 6/1987 | Fed. Rep. of Germany . |
| 387167 | 12/1964 | France . |
| 2542806 | 9/1984 | France . |

*Primary Examiner*—E. Rollins Cross
*Attorney, Agent, or Firm*—Ernest A. Beutler

[57] ABSTRACT

A motor vehicle power unit comprised of a transversely disposed in-line cylinder block inclined rearwardly. A crankshaft is contained within a dry sump crankcase positioned between the cylinder block and drives and output shaft through an intermediate gear. The output shaft and crankshaft define a plane that intersects a plane defined by the cylinder bores and crankshaft. A dry sump oil reservoir is positioned between these planes and the output shaft has a pulley that drives a plurality of engine accessories that lie forwardly of and over the cylinder block.

40 Claims, 4 Drawing Sheets

ENGINE UNIT FOR MOTOR VEHICLE

This is a division of U.S. patent application Ser. No. 270,260, filed Nov. 14, 1988, now U.S. Pat. No. 4,915,070.

BACKGROUND OF THE INVENTION

This invention relates to an improved engine unit for a motor vehicle and more particularly to an improved compact engine drive arrangement for such vehicles.

As is well known, the spatial requirements of motor vehicles are becoming quite critical. This is due to the increased complexity of the engines, transmissions and the number of accessories driven by the engine. Also, the configuration of modern motor vehicles and their streamlining dictates relatively small and sometimes undesirable configurations for the engine compartment in order to achieve the overall design effects of the vehicle. In order to achieve low hood lines and better streamlining, resort has been made to positioning the engine transversely in the engine compartment in a front engine, front wheel drive vehicle. Of course, such transverse engine locations in rear engine, rear wheel drive vehicles are also widely used. However, even though such an orientation can improve the layout of the engine compartment, there still is a problem in connection with the shape of the hood line. Specifically, if the engine cylinders are erect or forwardly inclined, they intrude into the forward portion of the hood area and dictate a high height in this region. This is unacceptable from both streamlining and aesthetic reason.

In addition to the orientation of the cylinders of the engine, the transverse postioning of the engine in the engine compartment also makes it extremely important to insure that the length of the engine (the portion extending transversely across the engine compartment) is short. As is well known, the power output of an engine and its efficiency can be increased if one or more overhead mounted camshafts are employed for operating the valve train. Conventionally such camshafts are driven off one end of the crankshaft and this obviously increases the length of the engine and gives rise difficulties to in placement of the engine transversely in the engine compartment.

It is, therefore, a principal object of this invention to provide an improved camshaft drive arrangement for an internal combustion engine.

It is a further object of this invention to provide an improved and compact camshaft drive arrangement for an internal combustion engine in which the length of the engine is not increased so as to permit the engine to be used in a transverse position in an engine compartment of a motor vehicle.

SUMMARY OF THE INVENTION

This invention is adapted to be embodied in a camshaft drive arrangement for an internal combustion engine having a plurality of cylinders aligned in a bank. A plurality of pistons are each received in a respective cylinder and drive a crankshaft that is rotatable about a first axis. An intermediate shaft is rotatable about a second axis parallel to the first axis and offset therefrom. First drives means drive the intermediate shaft from the crankshaft at a location spaced from one end of the crankshaft. A camshaft is supported for rotation about an axis parallel to the first and second axis and is offset therefrom. A plurality of valves are operated by the camshaft. Second drive means drive the camshaft at one end thereof from the intermediate shaft.

DETAILED DESCRIPTION OF THE PREFERRED EMBODIMENT OF THE INVENTION

Figure 1:
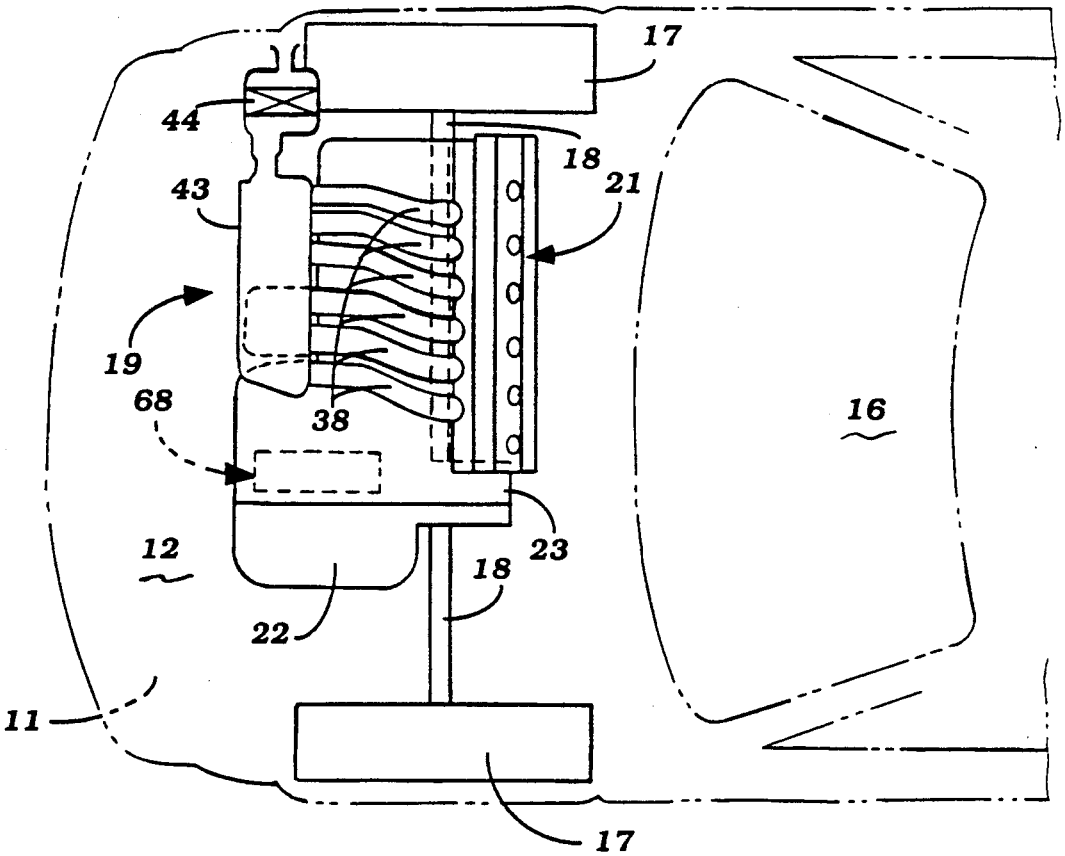
FIG. 1 is a top plan view of a portion of a motor vehicle having a power unit constructed in accordance with an embodiment of the invention. The power unit is shown in solid line and the motor vehicle is shown in phantom.
Figure 2:
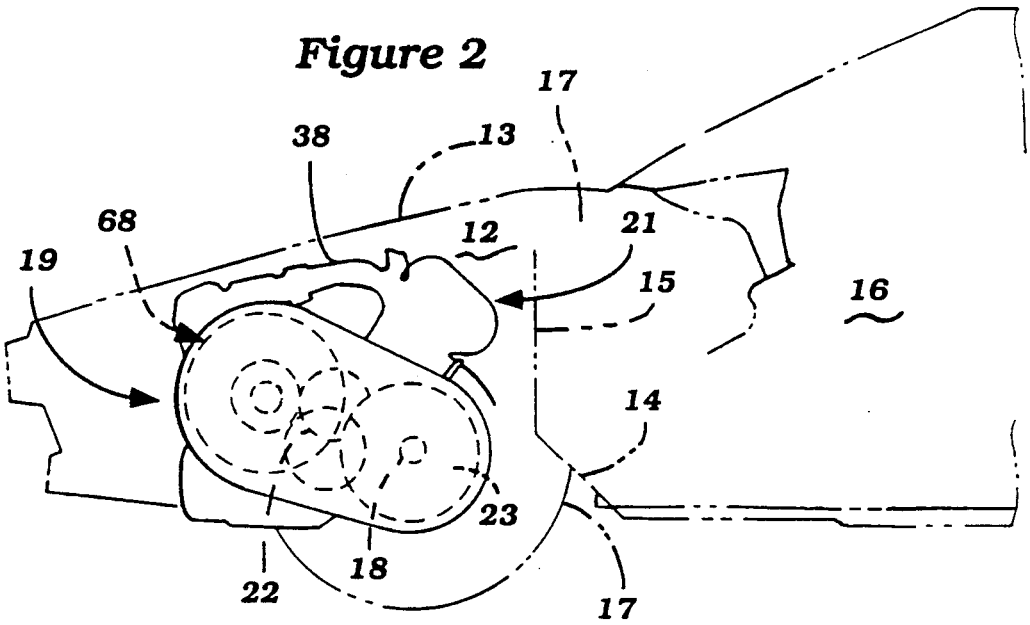
FIG. 2 is a side elevational view of the motor vehicle as shown in FIG. 1.

Referring first to FIGS. 1 and 2, a motor vehicle constructed in accordance with an embodiment of the invention is identified generally by the reference numeral 11. The motor vehicle 11 is depicted as being of the front engine, front wheel drive type and is adapted to carry one or more passengers. Although the invention is described in conjunction with such front engine, front wheel drive type vehicles, it is to be understood that the invention or at least certain facets of it have application with other types of motor vehicles or to engines per se.

The motor vehicle 11 is provided with a forwardly positioned engine compartment 12 that is defined in part by a downwardly sloping hood 13 of generally streamlined configuration. A toe board 14 and fire wall 15 separate the engine compartment 12 from a passenger's compartment 16 which may have any configuration. Inasmuch as the vehicle per se does not form a part of the invention, except insofar as its relationship the engine compartment 12 and the components contained therein, further discussion of the vehicle 11 is not believed to be required. Furthermore, for this reason, the vehicle 11 has been shown primarily in phantom.

The invention relates primarily to an arrangement for driving a pair of front wheels 17 of the vehicle 16. The front wheels 17 have associated with them axle shafts 18 by which the wheels are driven about axes of rotation that extend generally transverse to the vehicle 11. Of course, the front wheels 17 are supported for both suspension travel in a vertical direction and steering movement about generally vertically extending steering axes. To this end, the axle shafts 18 are connected to the front wheels 17 by means of homokinetic universal joints of any known type. The axle shafts 18 are powered by means of a power unit, indicated generally by the reference numeral 19 and which is comprised of an internal combustion engine 21, of a type to be described, a transmission 22 that is powered by the engine 21 and which drives the axle shafts 18 through a differential 23.

Figure 3:
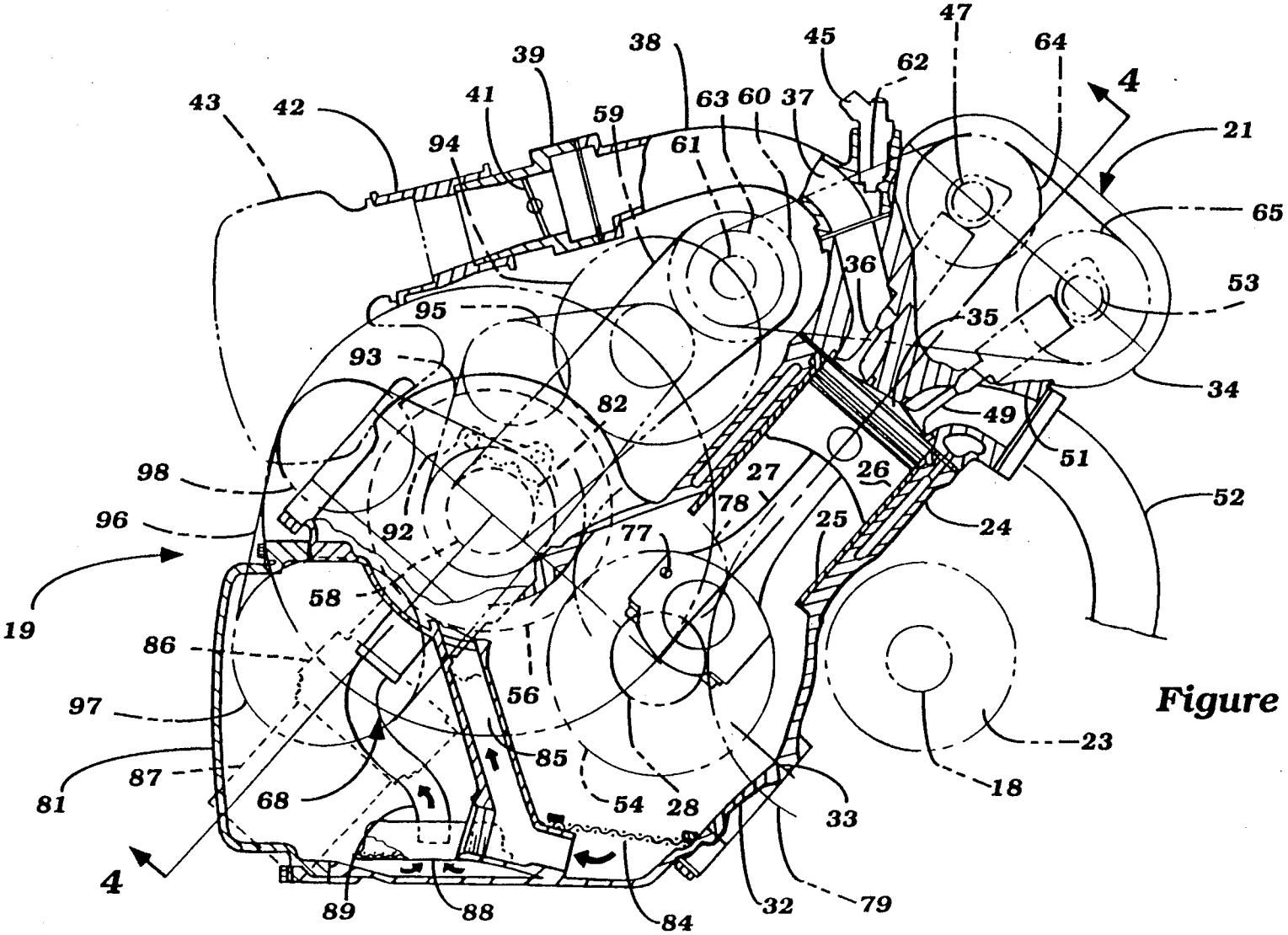
FIG. 3 is an enlarged side elevational view of the power unit, with portions broken away and other portions shown in section.
Figure 4:
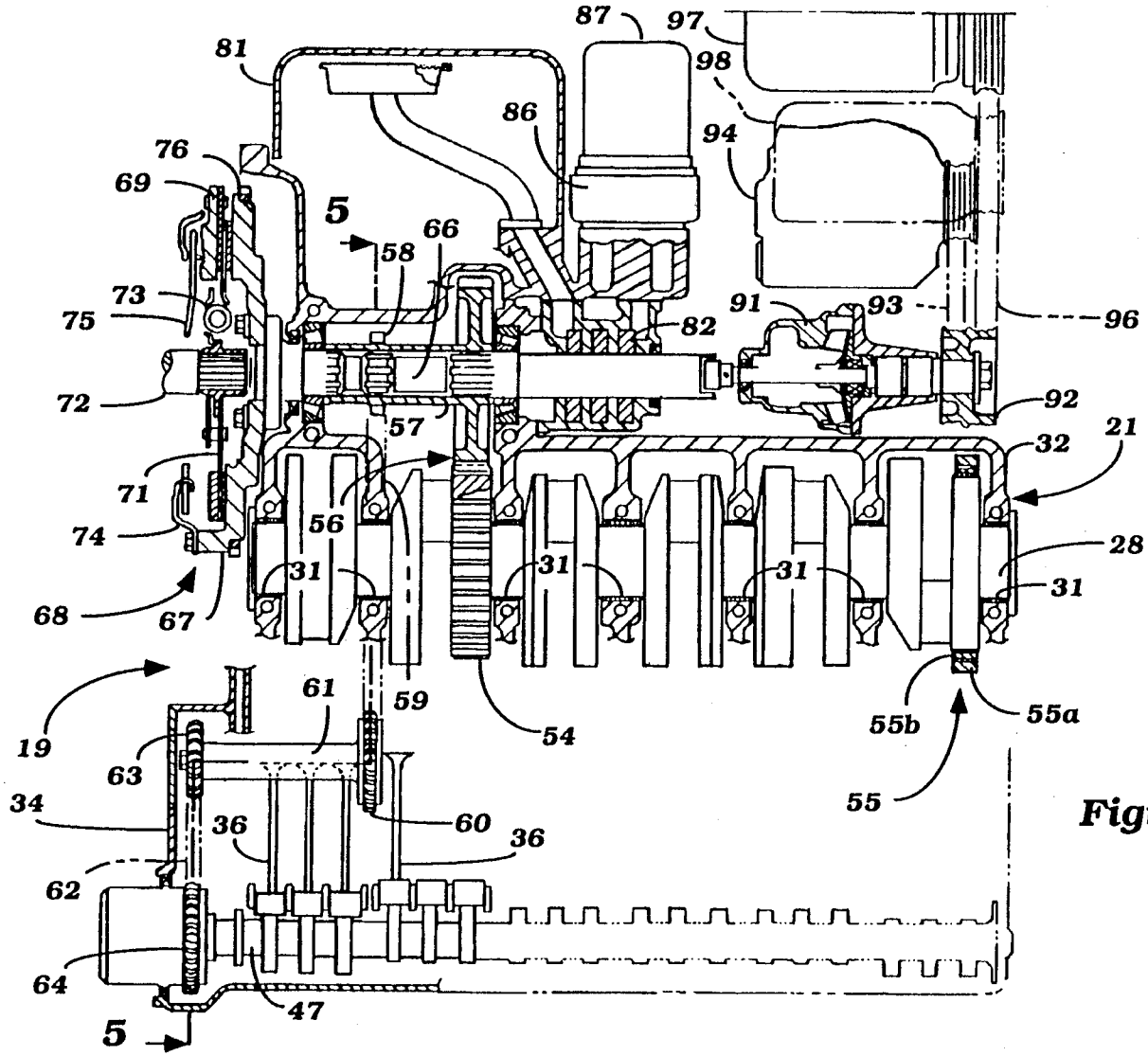
FIG. 4 is a cross-sectional view taken generally along the line 4—4 of FIG. 3.
Figure 5:
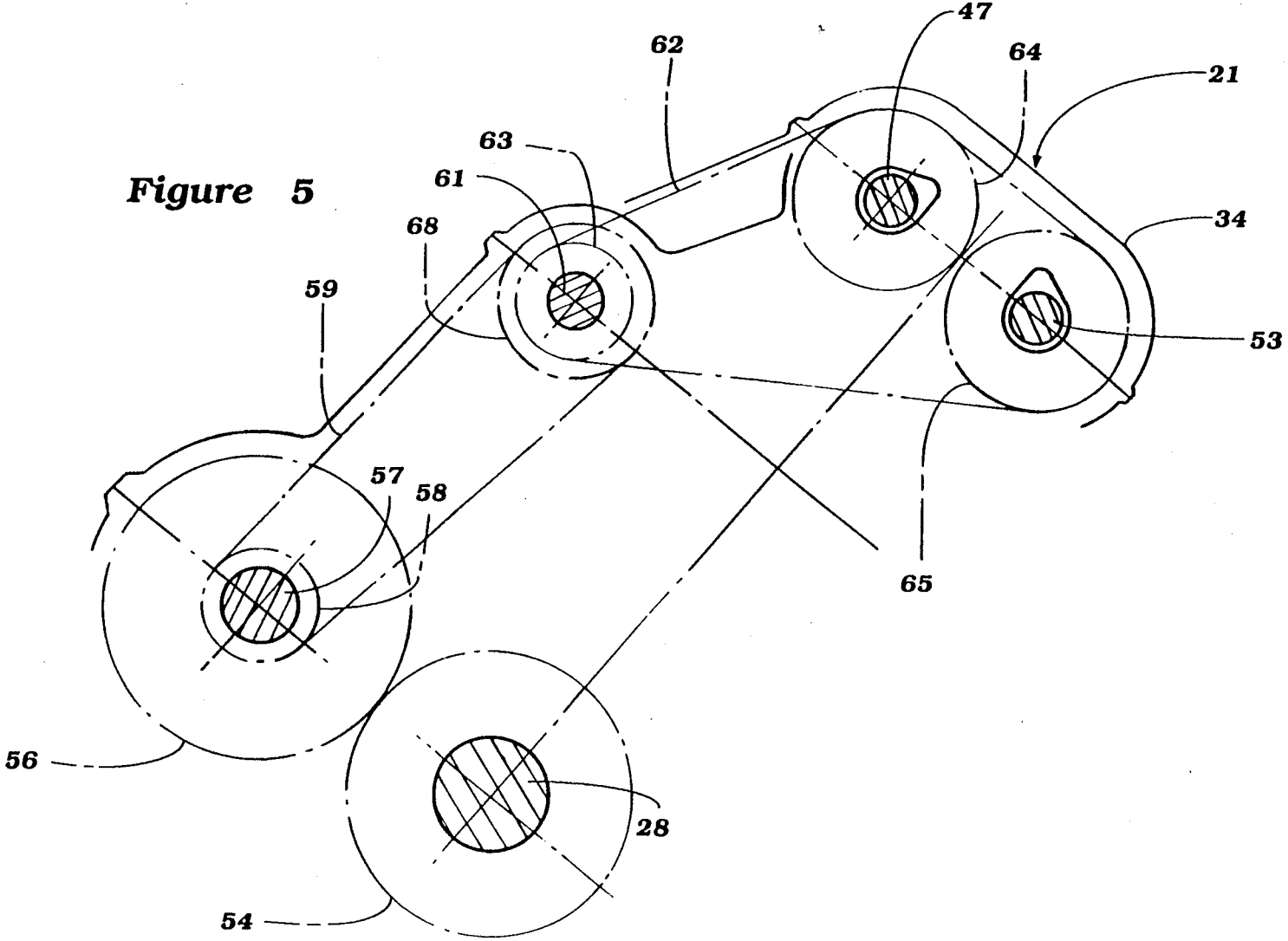
FIG. 5 is a cross-sectional view showing the camshaft drive arrangement on an enlarged scale and taken in the direction of the line 5—5 in FIG. 3.

Referring now additionally and primarily to FIGS. 3 through 5, the engine 21 may be of any known type. In the illustrated embodiment, the engine 21 is depicted as being of the in-line, six cylinder, four cycle type. It is to be understood, however, that the invention may be utilized in conjunction with engines having other cylinder numbers or other cylinder configurations. Also, certain facets of the invention may high employed in conjunction with engines other than those of those of the reciprocating type. However, the invention has particular utility in in-line type of engines.

The engine 21 is comprised of a cylinder block 24 which may be formed of a light weight material such as cast aluminum alloy and which has cylinder liners 25 that define cylinder bores in which pistons 26 reciprocate. The cylinder bore axes define a plane that is inclined rearwardly from the vertical. As such the cylinder block 24 overlies the axles 18. The pistons 26 are connected by means of connecting rods 27 to a crankshaft 28 that is journaled within a dry sump crankcase 29 of the engine 21 in a known manner, as by means of spaced main bearings 31. The crankcase 29 is defined by the lower end of the cylinder block 24 and a lower pan 32 that is joined to the cylinder block 24 in a suitable manner along an upwardly and forwardly inclined parting line 33.

A cylinder head 34 is affixed to the cylinder block 24 in a known manner and has individual recesses 35 that cooperate with the cylinder bores 24 and pistons 26 to define the engine combustion chambers. Intake valves 36 are slidably supported in the cylinder head 34 and cooperate with intake passages 37 formed in the cylinder head 34 and by an intake manifold 38 for delivering a fuel air charge to the combustion chambers 35. It should be noted that the manifold 38 has a generally arcuate configuration with individual runners for each of the combustion chambers 35 and/or intake valves 36. The manifold 38 curves arcuately forwardly and terminates in a throttle body 39 in which individual throttle valves 41 are positioned for controlling the flow through the manifold passages 37. An inlet connection 42 is affixed to each of the throttle bodies 39 and extends into a transversely extending plenum chamber 43 that is positioned forwardly of the engine and which extends transversely across the engine compartment 12. An air inlet and filter element 44 is positioned at one end of the plenum chamber 43 for delivery of filtered fresh air to the plenum chamber 43.

It should be noted that the arcuate configuration of the induction system permits it to be very compact and still fall well below the hood line 13. To this end, the cylinder block 24 is canted rearwardly so that the cylinder bores 25 are inclined rearwardly from a vertically extending plane and lie over the axle shafts 18. This permits a very compact arrangement as well as a low hood line 13 without sacrificing serviceability or operation of the engine.

Fuel injectors 45 are supported in the cylinder head 34 and discharge fuel supplied from a fuel rail into the cylinder head intake passages 37 in proximity to the intake valves 36. The fuel injection system is controlled by any suitable arrangement.

An intake camshaft 47 is supported within the cylinder head 34 in an appropriate manner and operates the intake valves 36. The intake camshaft 47 is driven in a manner to be described.

Exhaust valves 49 are supported in the cylinder head 34 in a known manner so as to control the flow of exhaust gases from the combustion chambers 35 into cylinder head exhaust passages 51. The exhaust passages 51 cooperate with an exhaust manifold 52 and exhaust system (not shown) for discharging the exhaust gases from the engine 21 to the atmosphere and for silencing these discharged exhaust gases. The exhaust valves 49 are operated by means of an exhaust camshaft 53 that is journaled within the cylinder head 34 and driven in a manner to be described.

With conventional engines, it is the practice to drive the camshafts 47 and 53 from a camshaft drive arrangement located at one end of the crankshaft 28. The disadvantage with such an arrangement is that it adds to the overall length of the engine. This is not particularly desirable in connection with transverse engine placement of the type herein described. Therefore, in order to reduce the overall length of the engine 21 while still maintaining a generally simple construction, one of the cheeks of one of the throws of the crankshaft 28 is generally continuous and cylindrical and is provided with an external gear 54. This gear 54 is preferably formed on one of the throws inwardly from one end of the crankshaft 28. In accordance with the illustrated embodiment, one cheek of the throw associated with the number two cylinder is formed with the gear 54. A torsional vibrator damper 55 comprised of an inertial mass **55*a* and elastic ring 55*b* is fixed to the opposite end of the crankshaft 28**.

The gear 54 meshes with a further gear 56 that is supported for rotation about an axis that is parallel to the axis of rotation of the crankshaft 28 but which is offset forwardly and slightly upwardly of it. This relationship may be best seen in FIG. 5 although it also appears in FIG. 3. The gear 56 is formed integrally with an auxiliary quill shaft 57 on which is formed a driving sprocket 58. A chain 59 transfers drive from the sprocket 58 to a sprocket 60 affixed to a cam driving shaft 61 that is journaled appropriately in the interface between the cylinder block 24 and cylinder head 34. A further chain 62 is driven by a sprocket 63 on the cam driving shaft 61 and drives sprockets 64 and 65 on the camshafts 47 and 53 respectively. If desired, an appropriate tensioner may be provided for the chains 59 and 62.

As is well known, the camshafts 47 and 53 are normally driven at one half crankshaft speed. Usually this is accomplished by means of a 2:1 gear or sprocket reduction between the crankshaft and the camshafts. Such large reductions in a single drive tend to cause the gears and/or sprockets to be unduly large. In accordance with this invention, a portion of the gear reduction occurs between the sprockets 58 and 60 and the remainder of the reduction occurs between the sprockets 63, 64 and 65 on the camshafts 47 and 53. In a preferred embodiment of the invention, the ratio between the sprockets 58 and 60 is approximately 0.8:1.0 and that between the sprocket 63 on the camshaft driving shaft 61 and the sprockets 64 and 65 on the camshafts 47 and 53 is approximately 0.62:1.0 so that the two ratios combined gives the desired 0.5 speed reduction.

An auxiliary shaft 66 that has a splined connection to the quill shaft 57 and which drives a flywheel 67 which forms a part of a clutch assembly, indicated generally by the reference numeral 68. The clutch assembly 68 is of the single plate type and includes a pressure plate 69 that is adapted to cooperate with a driven disk 71 for driving an input or primary shaft 72 of the transmission 22. There is provided a torsional damper 73 between the driven clutch disk 71 and the shaft 72 for absorbing torsional vibrations. A clutch cover 74 encloses the clutch mechanism and supports clutch actuating fingers 75 for selectively disengaging the clutch 68 in a known manner.

A starter ring gear 76 is either affixed to or formed integrally with the flywheel 67 and cooperates with a starter motor (not shown) for starting of the engine 21. The primary transmission shaft 72 carries a plurality of gears that are enmeshed with gears carried on a transmission secondary shaft, which does not appear in the figures but which rotates about an axis indicated by the point 77 in FIG. 3. It should be noted that this axis is offset toward the plane defined by the bores of the cylinders 25 but still positioned on the same side of this plane as the transmission primary shaft 72. These intermeshing gears are adapted to be selectively coupled for rotation with their respective shafts for driving the transmission secondary shaft 77 at preselected speed ratios from the transmission primary shaft 72. In addition, a lay shaft and reverse gear (not shown) is also incorporated in the transmission 19 for driving the secondary shaft 77 in a reverse direction, when desired.

Although a manual change speed type transmission has been described, it is to be understood that certain facets of the invention may also be employed in connection with automatic transmissions.

An output gear 78 is affixed for rotation with the transmission secondary shaft 77 and is enmeshed with a final drive gear 79 that provides the ring gear to the differential 23. As a result, an extremely compact drive is afforded.

It should be noted that the axis of the crankshaft 28 and transmission primary shaft 72 lie on a plane that extends at right angles to the plane encompassed by the bores of the cylinders 25. These intersecting planes define four quadrants in which certain accessories may be located in order to provide a compact arrangement. In addition, this arrangement permits the components to be located in an appropriate manner without substantially increasing the size of the power unit 19.

It has been previously noted that the crankcase 32 is of the dry sump type. An oil reservoir tank 81 is contained within one of the quadrants defined by the aforenoted planes. The oil reservoir tank 81 may conveniently be formed immediately adjacent the crankcase 32 and thus the use of external piping is avoided, as will be described.

It will be noted that the accessory shaft 66 extends outwardly from the crankcase 32 and has affixed to it a scavenge pump 82 and pressure pump 83 for the dry sump lubrication system. The pumps 82 and 83 may be of the gyroter type. The scavenge pump 82 draws collected oil from the bottom of the crankcase from beneath a screen 84 through a scavenge line 85. The oil is then pumped from the scavenge pump 82 though an oil cooler 86 and oil filter 87 and returned to the reservoir tank 81 through an appropriate conduit (not shown).

The pressure pump 83 picks oil from the external reservoir 81 through a strainer 88 and delivery line 89. The oil pressurized by the pressure pump 83 is delivered to the lubrication system of the engine in any suitable manner.

A water pump 91 is also driven off the end of the shaft 66 and thus is positioned in aligned relationship with the scavenge and delivery pumps 82 and 83. A pulley 92 is affixed to the end of the water pump 91 and drives a first belt 93 which drives an accessory such as an alternator or generator 94 that is positioned within another quadrant defined by the intersecting planes aforedescribed. An idler pulley 95 is positioned to maintain the tension in the belt 93.

A second belt 96 is driven by the pulley 92 and drives a pair of accessories which are located in the same quadrant as the tank 81, such accessories being, for example, an air conditioning compressor 97 and a power steering pump 98. It should be noted that all of the driven accessories 94, 97 and 98 are disposed forwardly of the cylinder block 24 so that the cylinder block 24 will, in effect, act as a silencing device so as to prevent the sounds from these accessories being transmitted back through the fire wall 15 to the engine compartment 16. Thus, a relatively compact yet highly serviceable and extremely silent arrangement is provided.

It should readily apparent from the foregoing description that the described power unit provides an extremely compact arrangement and yet affords ample servicing opportunity and also provides a low center of gravity, a good lubricating system and one in which the dry sump oil tank is positioned in close proximity to the engine and yet does not unnecessarily occupy space. Although an embodiment of the invention has been illustrated and described, various changes and modifications may be made without departing from the spirit and scope of the invention, as defined by the appended claims.

I claim:

1. In a camshaft drive arrangement for an internal combustion engine having a cylinder block with plurality of cylinders aligned in a bank, a plurality of pistons each received in a respective one of said cylinders and driving a crankshaft for rotation about a first axis, a cylinder head affixed to said cylinder block, an intermediate shaft rotatable about a second axis parallel to said first axis and offset to one side of said cylinder block and adjacent said cylinder head, first drive means for driving said intermediate shaft from said crankshaft at a location spaced from one end of said crankshaft a camshaft supported for rotation about a third axis parallel to said first and said second axis, by said cylinder head a plurality of valves in said cylinder head operated by said camshaft, and second drive means for driving said camshaft at one end thereof from said intermediate shaft.

2. In a camshaft drive arrangement for an internal combustion engine as set forth in claim 1 wherein at least one of the drive means includes a flexible transmitter.

3. In a camshaft drive arrangement for an internal combustion engine as set forth in claim 2 wherein the flexible transmitter comprises a chain.

4. In a camshaft drive arrangement for an internal combustion engine as set forth in claim 1 wherein the second drive means is disposed beyond the end of the crankshaft.

5. In a camshaft drive arrangement for an internal combustion engine as set forth in claim 4 wherein at least one of the drive means includes a flexible transmitter.

6. In a camshaft drive arrangement for an internal combustion engine as set forth in claim 5 wherein the flexible transmitter comprises a chain.

7. In a camshaft arrangement for an internal combustion engine as set forth in claim 1 wherein the first drive means is disposed between the ends of the crankshaft and between at least two throws thereof.

8. In a camshaft arrangement for an internal combustion engine as set forth in claim 7 wherein the second drive means is disposed beyond the end of the crankshaft.

9. In a camshaft arrangement for an internal combustion engine as set forth in claim 8 wherein at least one of the drive means includes a flexible transmitter.

10. In a camshaft arrangement for an internal combustion engine as set forth in claim 9 wherein the flexible transmitter comprises a chain.

11. In a camshaft arrangement for an internal combustion engine having a plurality of cylinders aligned in a bank, a plurality of pistons each received in a respective one of said cylinders and driving a crankshaft for rotation about a first axis, an intermediate shaft rotatable about a second axis parallel to said first axis and spaced therefrom first drive means for driving said intermediate shaft from said crankshaft at a location spaced from one end of said crankshaft, a camshaft supported for rotation about a third axis parallel to said first and said second axis and spaced therefrom, a plurality of valves operated by said camshaft, and second drive means for driving said camshaft at one end thereof from said intermediate shaft, said first drive means for driving said intermediate shaft further including an output shaft driven by said crankshaft by third drive means at a point spaced from said one end thereof.

12. In a camshaft arrangement for an internal combustion engine as set forth in claim 11 wherein the first drive means is disposed between the ends of the crankshaft and between at least two throws thereof.

13. In a camshaft arrangement for an internal combustion engine as set forth in claim 12 wherein the third drive means is disposed between at least two of the throws of the crankshaft and the first drive means further includes a flexible transmitter for driving the intermediate shaft from the output shaft.

14. In a camshaft arrangement for an internal combustion engine as set forth in claim 13 wherein at least one of the drive means includes a flexible transmitter.

15. In a camshaft arrangement for an internal combustion engine as set forth in claim 14 wherein the flexible transmitter comprises a chain.

16. In a camshaft arrangement for an internal combustion engine as set forth in claim 13 further including a second camshaft rotatable about a fourth axis parallel to the axis of the third axis and operating a further plurality of valves, the second drive means driving both of said camshafts from the intermediate shaft.

17. In a camshaft arrangement for an internal combustion engine as set forth in claim 16 wherein the second drive means comprises a single flexible transmitter for driving both of the camshafts from the intermediate shaft.

18. In a camshaft arrangement for an internal combustion engine as set forth in claim 17 wherein the single flexible transmitter comprises a chain.

19. In a camshaft arrangement for an internal combustion engine having a plurality of cylinders aligned in a bank, a plurality of pistons each received in a respective one of said cylinders and driving a crankshaft for rotation about a first axis, an intermediate shaft rotatable about a second axis parallel to said first axis and spaced therefrom first drive means for driving said intermediate shaft from said crankshaft at a location spaced from one end of said crankshaft, a camshaft supported for rotation about a third axis parallel to said first and said second axis and spaced therefrom, a plurality of valves operated by said camshaft, and second drive means for driving said camshaft at one end thereof from said intermediate shaft, said output shaft driving a final drive positioned on the opposite of said first axis from said second axis.

20. In a camshaft arrangement for an internal combustion engine as set forth in claim 19 wherein the output shaft drives the final drive through a chain drive transmission.

21. In a camshaft arrangement for an internal combustion engine having a plurality of cylinders aligned in a bank, a plurality of pistons each received in a respective one of said cylinders and driving a crankshaft for rotation about a first axis, an intermediate shaft rotatable about a second axis parallel to said first axis and spaced therefrom first drive means for driving said intermediate shaft from said crankshaft at a location spaced from one end of said crankshaft, a camshaft supported for rotation about a third axis parallel to said first and said second axis and spaced therefrom, a plurality of valves operated by said camshaft, and second drive means for driving said camshaft at one end thereof from said intermediate shaft, said cylinder bank being inclined to the vertical and said second axis being disposed forwardly of a plane containing said first and third axes.

22. In a camshaft drive arrangement for an internal combustion engine as set forth in claim 21 wherein at least one of the drive means includes a flexible transmitter.

23. In a camshaft drive arrangement for an internal combustion engine as set forth in claim 22 wherein the flexible transmitter comprises a chain.

24. In a camshaft drive arrangement for an internal combustion engine as set forth in claim 21 wherein the second drive means is disposed beyond the end of the crankshaft.

25. In a camshaft drive arrangement for an internal combustion engine as set forth in claim 21 wherein the second drive means is disposed beyond the end of the crankshaft.

26. In a camshaft drive arrangement for an internal combustion engine as set forth in claim 25 wherein the flexible transmitter comprises a chain.

27. In a camshaft arrangement for an internal combustion engine as set forth in claim 21 wherein the first drive means is disposed between the ends of the crankshaft and between at least two throws thereof.

28. In a camshaft arrangement for an internal combustion engine as set forth in claim 27 wherein the second drive means is disposed beyond the end of the crankshaft.

29. In a camshaft arrangement for an internal combustion engine as set forth in claim 28 wherein at least one of the drive means includes a flexible transmitter.

30. In a camshaft arrangement for an internal combustion engine as set forth in claim 29 wherein the flexible transmitter comprises a chain.

31. In a camshaft arrangement for an internal combustion engine as set forth in claim 21 wherein the means for driving the intermediate shaft further includes an output shaft driven by the crankshaft by third drive means at a point spaced from the one end thereof.

32. In a camshaft arrangement for an internal combustion engine as set forth in claim 31 wherein the first drive means is disposed between the ends of the crankshaft and between at least two throws thereof.

33. In a camshaft arrangement for an internal combustion engine as set forth in claim 32 wherein the third drive means is disposed between at least two of the throws of the crankshaft and the first drive means further includes a flexible transmitter for driving the intermediate shaft from the output shaft.

34. In a camshaft arrangement for an internal combustion engine as set forth in claim 33 wherein at least one of the drive means includes a flexible transmitter.

35. In a camshaft arrangement for an internal combustion engine as set forth in claim 34 wherein the flexible transmitter comprises a chain.

36. In a camshaft arrangement for an internal combustion engine as set forth in claim 33 further including a second camshaft rotatable about a fourth axis parallel to the axis of the first mentioned camshaft and operating a further plurality of valves, the second drive means driving both of said camshafts from the intermediate shaft.

37. In a camshaft arrangement for an internal combustion engine as set forth in claim 36 wherein the second drive means comprises a single flexible transmitter for driving both of the camshafts from the intermediate shaft.

38. In a camshaft arrangement for an internal combustion engine as set forth in claim 37 wherein the single flexible transmitter comprises a chain.

39. In a camshaft arrangement for an internal combustion engine as set forth in claim 31 wherein the output shaft drives a final drive positioned on the opposite of the first axis from the second axis.

40. In a camshaft arrangement for an internal combustion engine as set forth in claim 39 wherein the output shaft drives the final drive through a chain drive transmission.

* * * * *